United States Patent [19]

Kelly et al.

[11] 3,953,033

[45] Apr. 27, 1976

[54] GOLFER'S PUTTING STANCE ANALYZING DEVICE

[76] Inventors: Norman A. Kelly, 1514 Country Club Drive, Warsaw, Ind. 46580; Norris R. Libert, 501 Center St., Jupiter, Fla. 33458

[22] Filed: Oct. 10, 1974

[21] Appl. No.: 513,840

[52] U.S. Cl. ..... 273/183 E; 211/60 G; 33/174 F; 273/167 G

[51] Int. Cl.[2] ..... A63B 69/36

[58] Field of Search ..... 273/77 R, 77 A, 80 C, 273/183 R, 183 E, 186 R, 191 R, 192, 187, 35, 32, 167 G; 33/174 F; 35/29 A

[56] References Cited

UNITED STATES PATENTS

| | | | |
|---|---|---|---|
| 2,546,426 | 3/1951 | Bryant | 33/174 F |
| 3,253,829 | 5/1966 | Ford | 273/183 D |

FOREIGN PATENTS OR APPLICATIONS

| | | | |
|---|---|---|---|
| 435,483 | 9/1935 | United Kingdom | 273/183 E |

*Primary Examiner*—George J. Marlo
*Attorney, Agent, or Firm*—Woodhams, Blanchard & Flynn

[57] ABSTRACT

A display rack adapted to support and display a plurality of golf clubs, specifically putters. The rack has an alignment system associated therewith for permitting a golfer to analyze his putting stance and select a putter having the proper shaft angle. The alignment system includes an elongated vertically extending sight tube mounted on the rack and positioned above an alignment mark which represents the position of a golf ball. The sight tube has a calibrated arm projecting horizontally therefrom and adapted to be positioned adjacent the shaft of a putter when the head thereof is disposed adjacent the alignment mark. The calibrating arm has calibrations thereon which indicate the angle assumed by the putter shaft relative to the vertical axis of the sight tube.

6 Claims, 4 Drawing Figures

GOLFER'S PUTTING STANCE ANALYZING DEVICE

FIELD OF THE INVENTION

This invention relates to a display rack for golf clubs, particularly putters, and in particular to a display rack having an alignment device associated therewith for permitting the golfer to select a putter having a proper shaft angle for his individualized putting stance.

BACKGROUND OF THE INVENTION

Golfers differ in stature and girth, and consequently there is a great variance in the "head lie" (that is, shaft angle) requirements of a putter suitable for a tall golfer in contrast to a putter suitable for a short golfer. To compensate for this variance, most putters are made with a bottom surface or sole which functions as a rocker for permitting the golfer to vary the shaft angle to accommodate their own particular putting stance. However, this rocker sole creates an additional problem since it is extremely difficult for the golfer to repetitively position the club in the proper angular relationship each and every time same is used. This rocker sole thus results in the position of the shaft varying by several degrees during usage of the putter, which variation may be caused by raising or lowering the hands, or stooping over too much or not enough. These variables thus affect the directional control of the putter and result in inaccurate putts.

While putters have been produced with a flat sole in an attempt to eliminate this variance in the shaft angle, nevertheless these putters have been provided with a fixed shaft angle and have not permitted the golfer to determine the proper shaft angle which is compatible with each golfer's putting stance. Thus, many golfers utilize putters which have an improper shaft angle, which in turn results in the golfer not being properly vertically aligned over the ball so that such putters again result in undesired variations in the putting stroke.

Accordingly, it is an object of the present invention to overcome the above-mentioned disadvantages by providing a display rack for golf putters, which display rack includes an alignment device which permits each golfer to individually analyze his putting stance and determine the correct fixed shaft angle suitable for use with a flat bottomed putter so as to permit the golfer to position his head in alignment over the ball while putting. The present invention thus permits each golfer to select a flat bottomed putter having a fixed shaft angle compatible with the golfer's putting stance, while at the same time permitting the golfer's head to be properly vertically aligned over the ball whereby the flat sole of the putter coupled with the fixed angle of the shaft permits the golfer to more certainly and repeatedly attain good alignment over the ball while putting.

Other objects and purposes of the invention will be apparent to persons acquainted with structures of this type upon reading the following specification and inspecting the accompanying drawings.

Figure 4:
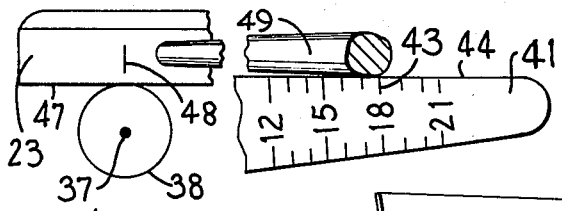
FIG. 4 is a fragmentary view taken along the line IV—IV in FIG. 3.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the device and designated parts thereof. Said terminology will include the words above specifically mentioned, derivatives thereof and words of similar import.

SUMMARY OF THE INVENTION

The objects and purposes of the present invention, including those mentioned above, have been met by providing a display rack which permits a plurality of putters having a flat sole to be supported and displayed thereon. An alignment device is mounted on the display rack for permitting a golfer to determine the proper angle of the putter shaft compatible with the golfer's own putting stance. The alignment device includes a vertically elongated hollow sight tube which is spaced upwardly a small distance from an alignment plate which is disposed on the floor. The alignment plate has an alignment dot or circle representative of a golf ball formed thereon and aligned with the sight tube. An angle calibration arm is horizontally swingably mounted on the sight tube and projects outwardly therefrom, which arm has a plurality of calibrations thereon representative of various shaft angles. The golfer assumes his putting stance adjacent the display device so that the head of the putter is adjacent the alignment circle, with the head of the golfer being disposed vertically above and in alignment with the sight tube so that the golfer can visually sight downwardly through the tube and see the alignment circle. The calibrating arm is positioned adjacent the shaft of the putter and, where the putter shaft intersects the arm, permits a visual determination as to the proper angle for the putter shaft so as to result in the putter being compatible with the individual putting stance of the golfer.

DETAILED DESCRIPTION

Figure 1:
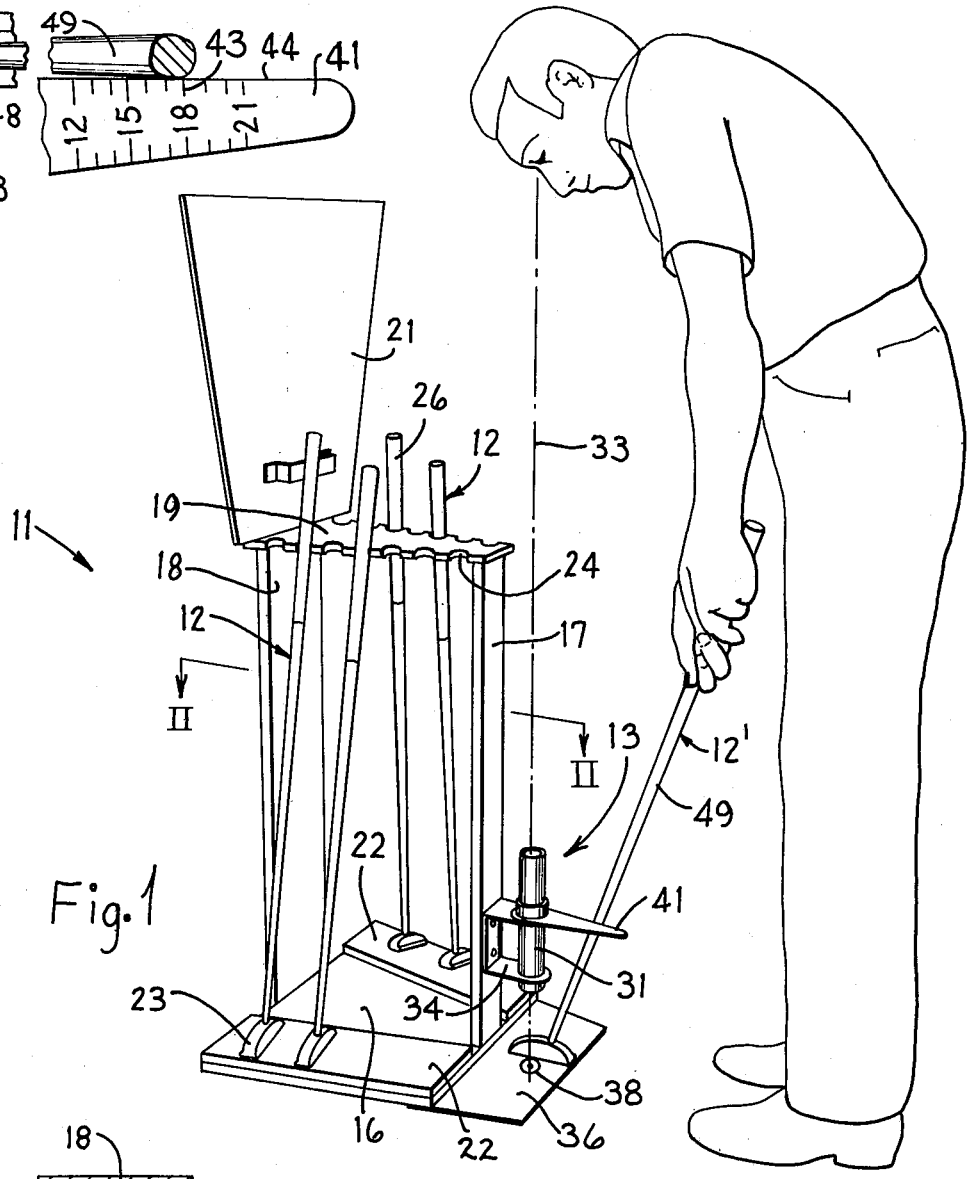
FIG. 1 is a perspective view of a display rack according to the present invention.

FIG. 1 illustrates therein a display rack 11 according to the present invention, which rack is designed to support and display thereon a plurality of putters 12. The rack 11 has an alignment device 13 associated therewith for permitting determination of proper shaft angle. The alignment device 13 is illustrated in FIG. 1 as being utilized by a golfer 14 so as to permit determination of the proper shaft angle for a putter 12'.

The rack 11 includes a substantially flat base 16 which is adapted to be supported on a floor or other suitable support surface. Front and rear uprights or posts 17 and 18, respectively are fixed to the base 16 and project upwardly therefrom in a vertical direction. A substantially V-shaped top plate 19 is secured to the upper ends of the uprights 17 and 18. Rack 11 may also be optionally provided with a substantially vertical display board 21, which board 21 is fixed adjacent the upper end of the rear upright and projects upwardly above the top plate 19.

The base 16 has a pair of support pads 22 secured thereto, which support pads may comprise segments or mats constructed from artificial grass, carpeting or the like. The support pads 22 support thereon the heads 23 of the putters 12. The top plate 19 of the display rack has a plurality of notches 24 formed along the opposite edges thereof, which notches receive therein the handles 26 of the putters 12, whereby the putters are supported and displayed in the manner illustrated in FIG. 1.

Considering now the alignment device 13, same includes an elongated hollow sight tube or scope 31 having an elongated opening 32 extending therethrough. The tube 31 is disposed with its axis 33 extending substantially vertically and is fixedly mounted on the rack 11 by means of a U-shaped bracket 34, which bracket 34 in the illustrated embodiment is secured to the front upright 17. The tube 31 preferably has a length of several inches, such as between approximately four and twelve inches, and the opening 32 has a diameter which is approximately 1½ inches, which is approximately the diameter of a golf ball.

The lower end of the sight tube 31 is spaced upwardly a small distance, such as between three and six inches, from a substantially horizontal alignment plate 36, which plate 36 is fixed to the base 16 and is adapted to be supported on the floor or other support surface. The alignment plate 36 has an alignment dot 37 formed thereon, which dot is aligned with the vertical axis 33. The alignment plate 36 also preferably has an alignment circle 38 formed thereon concentric with the dot 37, which circle 38 approximates the diameter of a golf ball and thus visually represents a golf ball when same is viewed through the sight tube 31.

Figure 2:
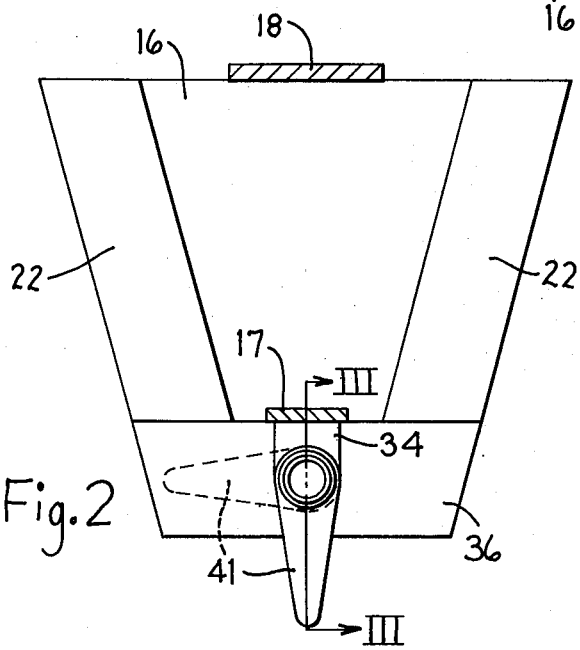
FIG. 2 is a sectional view taken along the line II—II in FIG. 1.

The sight tube 31 has an angle calibrating arm 41 mounted thereon and projecting radially outwardly therefrom in a substantially horizontally direction. Arm 41 has a sleeve portion 42 on the inner end thereof which is rotatably supported on the tube 31 so that the arm 41 can be swingably moved about the axis 33. The arm 41 is thus movable between the positions illustrated by solid and dotted lines in FIG. 2. A plurality of calibrations 43 are formed on the upper surface of the arm, which calibrations project inwardly from the opposite side edges 44 of the arm. As illustrated in FIG. 4, the calibrations 43 have been numbered "12", "15", "18" and "21", which numbers designate the shaft angle, as explained in greater detail hereinafter.

OPERATION

The operation of the rack according to the present invention will be briefly described to ensure a complete understanding thereof.

When a golfer desires to determine the correct shaft angle which is compatible with his own putting stance, then the golfer initially assumes his putting stance using his own putter so that the striking face 47 of the putter head 23 is positioned adjacent the alignment circle 38. Upon assuming his own putting stance, the golfer is positioned substantially as illustrated in FIG. 1 so that his head is disposed directly over the tube 31. The golfer can then visually sight downwardly through the tube and see the ball as illustrated by the alignment circle 38. The calibrating arm 41 is then swung around from the dotted line position into the solid line position illustrated in FIG. 2, in which position the edge 44 of the arm 41 is positioned directly adjacent the putter shaft 49. The calibration number on the arm 41 which is located nearest the center of the shaft 49 thus indicates the correct fixed angle needed to repeatedly attain this putting position. For example, if the shaft 49 intersects the arm 41 adjacent the mark designated 15, then this indicates that the golfer needs a putter having a fixed shaft angle of 15° relative to the vertical.

Figure 3:
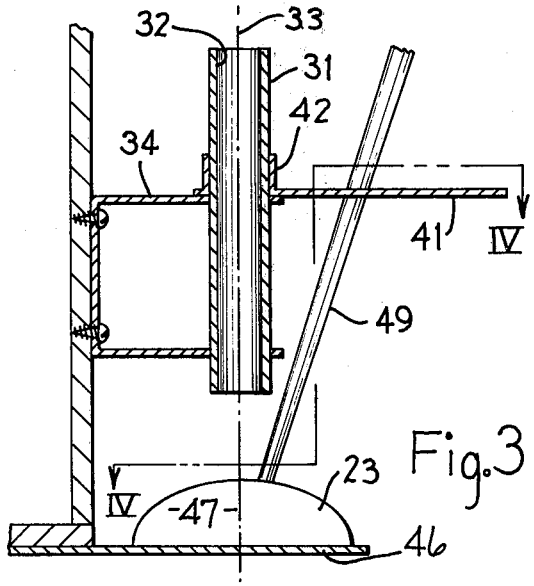
FIG. 3 is an enlarged, fragmentary sectional view taken along the line III—III in FIG. 2.

After the golfer has determined the correct shaft angle, as described above, this can then be checked by having the golfer assume the same position illustrated in FIG. 1, but this time utilizing a putter having the determined shaft angle (that is, 15°), and with the putter additionally having a flat sole 46 as illustrated in FIG. 3. The head 23 of the putter is again positioned so that the striking face 47 is adjacent the alignment circle 38. The head of the putter 23 is also preferably provided with an alignment line or mark 48 thereon which indicates the centroid of the putter head, which mark 48 is positioned to align with the alignment dot 37 as illustrated in FIG. 4. With the putter head 23 positioned as shown in FIGS. 3 and 4, and with the flat sole 46 of the putter head resting on the alignment plate 36, then the shaft 49 should again intersect the arm 41 at the same calibration position (i.e. 15°) when the golfer assumes his normal putting stance with his head properly aligned over the sight tube 31.

The flat sole 46 of the putter, combined with the proper shaft angle, thus permits the golfer to repetitively assume the proper putting stance.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. A device for determining the proper shaft angle for a putter, comprising:

stationary base means having a substantially horizontal plate adapted to be disposed on the floor, said plate having an alignment mark thereon;

vertical sighting means mounted on said base means and spaced upwardly from said plate, said sighting means being vertically aligned with said mark;

said vertical sighting means comprising an elongated hollow tube positioned vertically and defining a vertical line of sight which is substantially aligned with said mark, said tube having the lower end thereof spaced upwardly from said plate; and means coacting with said sighting means for determining the angle of a putter shaft relative to the vertical when the putter head is located adjacent said mark.

2. A device according to claim 1, wherein said hollow tube has an opening extending therethrough which has a diameter which is of the same order of magnitude as the diameter of a golf ball.

3. A device according to claim 1, wherein the means for determining the angle of a putter shaft includes an arm projecting substantially horizontally away from the vertical sight line defined by said sighting means.

4. A device according to claim 3, further including means mounting said arm for swinging movement relative to said base means about a substantially vertical axis.

5. A device according to claim 3, wherein said arm is horizontally swingable relative to said base means about said vertical sight line.

6. A device according to claim 5, wherein said arm has an upper surface with indicia thereon for visually indicating the angle of a putter shaft.

* * * * *